US008874012B2

(12) United States Patent
Yamada et al.

(10) Patent No.: US 8,874,012 B2
(45) Date of Patent: Oct. 28, 2014

(54) DEVELOPING MEMBER, PROCESS CARTRIDGE AND ELECTROPHOTOGRAPHIC APPARATUS

(71) Applicant: Canon Kabushiki Kaisha, Tokyo (JP)

(72) Inventors: Masaki Yamada, Mishima (JP); Yuji Sakurai, Susono (JP); Toru Ishii, Numazu (JP); Takashi Koyanagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/089,732

(22) Filed: Nov. 25, 2013

(65) Prior Publication Data

US 2014/0079442 A1 Mar. 20, 2014

Related U.S. Application Data

(63) Continuation of application No. PCT/JP2013/003959, filed on Jun. 25, 2013.

(30) Foreign Application Priority Data

Jun. 27, 2012 (JP) ..... 2012-144331
Jun. 19, 2013 (JP) ..... 2013-128802

(51) Int. Cl.
*G03G 15/08* (2006.01)

(52) U.S. Cl.
CPC ..... *G03G 15/0806* (2013.01); *G03G 15/0818* (2013.01)
USPC ..... 399/286; 29/895; 492/53

(58) Field of Classification Search
USPC ..... 399/286, 279, 265; 492/18, 49, 53, 56; 29/895
See application file for complete search history.

(56) References Cited

U.S. PATENT DOCUMENTS 7,797,833 B2 9/2010 Nakamura et al.
7,799,398 B2 9/2010 Nakamura et al.
8,088,876 B2 1/2012 Yoshida et al.
8,600,273 B2 * 12/2013 Yamada et al. ..... 399/286

(Continued)

FOREIGN PATENT DOCUMENTS

JP 57-5047 A 1/1982
JP 2004-339253 A 12/2004

(Continued)

OTHER PUBLICATIONS

PCT International Search Report and Written Opinion of the International Searching Authority, International Application No. PCT/JP2013/003959, Mailing Date Aug. 13, 2013.

*Primary Examiner* — Sophia S Chen
(74) *Attorney, Agent, or Firm* — Fitzpatrick, Cella, Harper and Scinto

(57) ABSTRACT

A high quality developing member that is excellent in deformation recovery property under a high temperature and that also satisfies filming resistance under a low temperature is provided. The developing member of the present invention includes a mandrel, an elastic layer formed on the outer periphery surface of the mandrel, and a surface layer covering the outer periphery surface of the elastic layer, wherein the surface layer contains a first resin and a second resin, the first resin has a particular structure between adjacent two urethane linkages, and the second resin is a resin having a particular structure and having a glass transition point Tg of 20° C. or higher and 120° C. or lower.

11 Claims, 4 Drawing Sheets

(56) References Cited

U.S. PATENT DOCUMENTS

| | | | | |
|---|---|---|---|---|
| 8,655,222 | B2 | 2/2014 | Nakamura et al. | |
| 2012/0195631 | A1 | 8/2012 | Yamada et al. | |
| 2013/0004211 | A1 | 1/2013 | Ishii et al. | |
| 2013/0028634 | A1 * | 1/2013 | Koyanagi et al. | 399/286 X |
| 2013/0243480 | A1 | 9/2013 | Sakurai et al. | |
| 2013/0287454 | A1 | 10/2013 | Anan et al. | |
| 2014/0064792 | A1 | 3/2014 | Kawamura et al. | |
| 2014/0064797 | A1 | 3/2014 | Yamada et al. | |
| 2014/0072350 | A1 | 3/2014 | Urushihara et al. | |
| 2014/0093278 | A1 * | 4/2014 | Yamada et al. | 399/286 X |
| 2014/0105646 | A1 | 4/2014 | Ishida et al. | |

FOREIGN PATENT DOCUMENTS

| | | | |
|---|---|---|---|
| JP | 2008-139482 | A | 6/2008 |
| JP | 2009-74052 | A | 4/2009 |
| JP | 2012-150453 | A | 8/2012 |

* cited by examiner

DEVELOPING MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2013/003959, filed on Jun. 25, 2013, which claims the benefit of Japanese Patent Applications No. 2012-144331, filed on Jun. 27, 2012 and No. 2013-128802, filed on Jun. 19, 2013.

BACKGROUND OF THE INVENTION

1. Field of the Invention

The present invention relates to a developing member to be incorporated in an apparatus adopting an electrophotographic system, such as a copier, a printer, or a receiving apparatus for a facsimile, for use in contact with or in close proximity to a photosensitive member, and a process cartridge and an electrophotographic apparatus having the developing member.

2. Description of the Related Art

In a copier, a facsimile, a printer or the like using an electrophotographic system, an electrophotographic photosensitive member (hereinafter, also referred to as "photosensitive member") is charged by a charging unit, and exposed by a laser or the like to form an electrostatic latent image on the photosensitive member. Then, a toner in a developing container is applied on a developing member by a toner supplying roller and a toner regulating member, and the electrostatic latent image on the photosensitive member is developed by the toner on a contact portion between the photosensitive member and the developing member, or in close proximity of the contact portion. Thereafter, the toner on the photosensitive member is transferred by a transfer unit to recording paper and fixed by heat and pressure, and the toner remaining on the photosensitive member is removed by a cleaning blade.

In an image forming apparatus with a non-magnetic one-component contact developing system, a conductive electrophotographic member having an electric resistance of $10^3$ to $10^{10}$ Ω·cm is generally used for a developing member.

In recent years, performances required for a developing member for use in an apparatus adopting an electrophotographic system have been made higher, and a developing member such as a developing roller having two layers, in which a surface layer is provided on the surface of an elastic layer, has been often used from the viewpoints of high image property and high durability.

For the surface layer in the developing member, a urethane resin excellent in wear resistance and charge-imparting property to a toner is widely used. In recent years, an improved technique of the surface layer has also been proposed in order that the function of a charging member may be further enhanced. Japanese Patent Application Laid-Open No. 2004-339253 discloses that a urethane resin is allowed to contain an acrylic resin to enhance wear resistance and slidability. In addition, Japanese Patent Application Laid-Open No. 2008-139482 discloses that a polyether-based urethane resin is allowed to contain an acrylic resin having predetermined physical properties to suppress toner adhesion under a high-temperature and high-humidity environment.

SUMMARY OF THE INVENTION

By the way, an electrophotographic apparatus has been increasingly used around the world and has been demanded for being able to stably output a high image quality electrophotographic image over a long period under various environments. For this purpose, it is necessary that the sticking of a toner on the surface of a developing member hardly occur even under a low-temperature and low-humidity environment (for example, an air temperature of 15° C. and a relative humidity of 10% (10% RH)). For this purpose, the surface layer of the developing member can be configured to be more flexible.

On the other hand, in the case where a developer regulating blade or the like stands still over a long period while abutting the surface of a developing member having a flexible surface layer, a deformation that is not easily recovered may occur on a part abutting the developer regulating blade, of the surface layer. Such a deformation is hereinafter referred to as compression permanent distortion, or compression set, abbreviated as C set.

In the case where a developing member on which C set has occurred is used for forming an electrophotographic image, a part on which C set has occurred is different from other part in terms of toner conveying property, and thus has an influence on the quality of an electrophotographic image. C set easily occurs in such a case that a developing member is left to stand while abutting another member, in particular, under a high-temperature and high-humidity environment.

The present invention is directed to providing a developing member on which the sticking of a toner on the surface is suppressed and C set hardly occurs. Further, the present invention is directed to providing an electrophotographic apparatus and a process cartridge that serve to stably output a high quality electrophotographic image.

According to one aspect of the present invention, there is provided a developing member including a mandrel, an elastic layer formed on the outer periphery surface of the mandrel, and a surface layer containing a urethane resin and covering the outer periphery surface of the elastic layer, wherein the surface layer contains a first resin and a second resin, the first resin has at least one structure selected from the group consisting of the following (A) and (B) between adjacent two urethane linkages, (A) a structure represented by the following structural formula (1), and one or both structures selected from the group consisting of a structure represented by the following structural formula (2) and a structure represented by the following structural formula (3); (B) a structure represented by the following structural formula (4); and the second resin has a structure of the following structural formula (5), and has a glass transition point Tg of 20° C. or higher and 120° C. or lower:

structural formula (1)

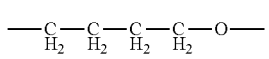

structural formula (2)

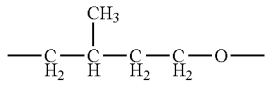

structural formula (3)

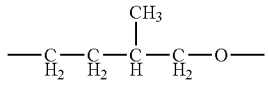

structural formula (4)

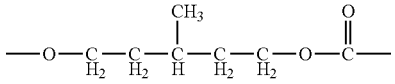

-continued structural formula (5)

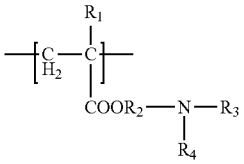

In the structural formula (5), $R_1$ represents a hydrogen atom or a methyl group, $R_2$ represents an alkylene group having 1 to 4 carbon atoms, and $R_3$ and $R_4$ each independently represent an alkyl group having 1 or 2 carbon atoms.

According to another aspect of the present invention, there is provided a developing member including a mandrel, an elastic layer formed on the outer periphery surface of the mandrel, and a surface layer covering the outer periphery surface of the elastic layer, wherein the surface layer is made of a reaction product of a polyol having at least one structure selected from the group consisting of the following (A) and (B), an acrylic resin having a structure represented by the following structural formula (6), and having a glass transition point Tg of 50° C. or higher and 120° C. or lower, and an isocyanate compound: (A) a structure represented by the following structural formula (1), and one or both structures selected from the group consisting of a structure represented by the following structural formula (2) and a structure represented by the following structural formula (3); (B) a structure represented by the following structural formula (4):

structural formula (1)

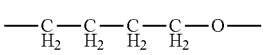

structural formula (2)

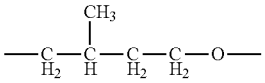

structural formula (3)

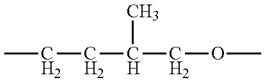

structural formula (4)

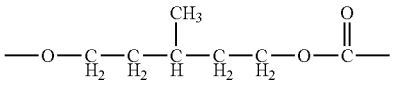

structural formula (6)

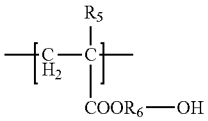

wherein, $R_5$ represents a hydrogen atom or a methyl group, and $R_6$ represents an alkylene group having 1 to 4 carbon atoms.

According to further aspect of the present invention, there is provided a developing member including a mandrel, an elastic layer formed on the outer periphery surface of the mandrel, and a surface layer covering the outer periphery surface of the elastic layer, wherein the surface layer contains a urethane resin, the urethane resin has a partial structure having at least one structure selected from the group consisting of the following (A) and (B) between adjacent two urethane linkages, and the urethane resin has a partial structure having a structure of the following (C), and not having the structures of the following (A) and (B) between adjacent two urethane linkages: (A) a structure represented by the following structural formula (1), and one or both structures selected from the group consisting of a structure represented by the following structural formula (2) and a structure represented by the following structural formula (3);

structural formula (1)

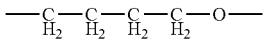

structural formula (2)

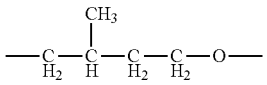

structural formula (3)

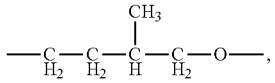

(B) a structure represented by the following structural formula (4);

structural formula (4)

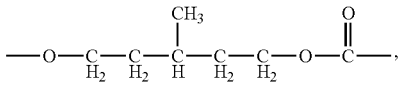

(C) a structure represented by the following structural formula (7), and one or both structures selected from the group consisting of a structure represented by the following structural formula (8) and a structure represented by the following structural formula (9);

structural formula (7)

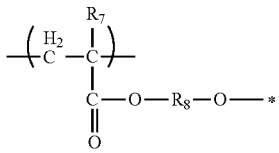

wherein, $R_7$ represents a hydrogen atom or an alkyl group having 1 to 3 carbon atoms, $R_8$ represents an alkylene group having 1 to 4 carbon atoms, and symbol "*" represents a linking position to a carbon atom constituting a urethane linkage;

structural formula (8)

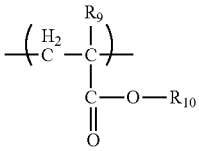

wherein, $R_9$ represents a hydrogen atom or a methyl group, and $R_{10}$ represents an alkyl group having 1 or 2 carbon atoms.

structural formula (9)

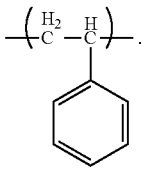

According to further another aspect of the present invention, there is provided an electrophotographic apparatus provided with the developing member and an electrophotographic photosensitive member arranged abutting the developing member.

According to still another aspect of the present invention, there is provided a process cartridge provided with the developing member and an electrophotographic photosensitive member arranged abutting the developing member, wherein the process cartridge is configured to be detachable to a main body of an electrophotographic apparatus.

The present invention can achieve a developing member that has a surface layer having above-described particular structural units to thereby allow C set to hardly occur even under high-temperature and high-humidity and allow toner filming to hardly occur even under low-temperature and low-humidity. The present invention can also achieve a process cartridge and an electrophotographic apparatus that enable a high quality electrophotographic image to be stably formed even under various environments.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
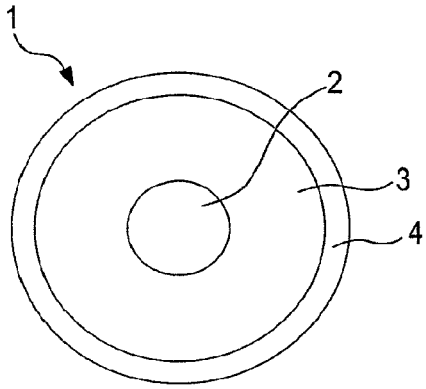
FIG. 1 is a schematic view illustrating one example of a developing roller of the present invention.

A roller-shaped developing member according to the present invention (hereinafter, also referred to as "developing roller") 1 is configured, as illustrated in FIG. 1, from a conductive member in which an elastic layer 3 is secured on the outer periphery surface of a columnar or hollow cylindrical conductive mandrel 2 and a surface layer is laminated on the outer periphery surface of the elastic layer 3 to cover the elastic layer 3.

[Conductive Mandrel]

The conductive mandrel 2 serves as an electrode and a supporting member of the developing roller 1, and is made of a metal or an alloy such as aluminum, a copper alloy, or stainless steel; chromium, or iron subjected to a plating treatment with nickel; or a conductive material such as a synthetic resin having conductivity.

Herein, a primer may be applied on the surface of the mandrel in order to enhance the adhesion property between the mandrel and an elastic layer described later. Examples of the primer that can be used include a silane coupling agent-based primer, and urethane-based, acrylic, polyester-based, polyether-based or epoxy-based thermosetting resin and thermoplastic resin.

In addition, a commercially available primer includes the following: "DY39-051," "DY39-012," and "DY39-115" (all are trade names: produced by Dow Corning Toray Co., Ltd.); "X-33-173," "PRIMER-NO. 4," "PRIMER-NO. 32," and "PRIMER-NO. 35" (all are trade names: produced by Shin-Etsu Chemical Co., Ltd.); and "XP81-405," "XP81-A6361," "XP81-B7015," "ME21," "ME151," "ME153," and "XC9214" (all are trade names: produced by Momentive Performance Materials Japan LLC).

A known alkoxysilane or titanate, or the like may also be added to the primer in order to enhance the adhesion property of the primer. Specific examples include tetramethoxysilane, tetraethoxysilane, tetra-n-butoxysilane, titanium tetraethoxide, titanium tetraisopropoxide, and titanium tetra-n-butoxide. The amount added can be 0.1 to parts by mass based on 100 parts by mass of a commercially available primer.

[Elastic Layer]

In order that a toner may be supplied to an electrostatic latent image formed on the surface of a photosensitive member in just proportion, the elastic layer imparts to the developing roller such hardness and elasticity that the developing roller is pressed to the photosensitive member by means of an appropriate nip width and nip pressure. The elastic layer 3 can be usually formed of a molded body of a rubber material. The rubber material includes the following: an ethylene-propylene-diene copolymerized rubber (EPDM), an acrylonitrile-butadiene rubber (NBR), a chloroprene rubber (CR), a natural rubber (NR), an isoprene rubber (IR), a styrene-butadiene rubber (SBR), a fluoro-rubber, a silicone rubber, an epichlorohydrin rubber, a hydrogenated NBR, and a urethane rubber. These rubbers can be used alone or as a mixture of two or more thereof. Among these rubbers, in particular, a silicone rubber can be used because of hardly resulting in compression permanent distortion on the elastic layer even in the case where the elastic layer abuts another member (developer regulating blade and the like) over a long period. Then, specific examples of the silicone rubber include a cured product of an addition-curable silicone rubber. Specific examples of the addition-curable silicone rubber include the following: polydimethylsiloxane, polymethyltrifluoropropylsiloxane, polymethylvinylsiloxane, and polyphenylvinylsiloxane.

The thickness of the elastic layer 3 preferably ranges from 1.5 to 5.0 mm, more preferably ranges from 2.0 to 4.0 mm.

Various additives such as a conductivity-imparting agent, a non-conductive filler, a crosslinking agent, and a catalyst are appropriately compounded in the elastic layer 3. As the conductivity-imparting agent, carbon black; conductive metals such as aluminum and copper; and fine particles of conductive metal oxides such as zinc oxide, tin oxide, and titanium oxide can be used. Among these conductivity-imparting agents, carbon black can be in particular used because of being relatively easily available and achieving a good conductivity. In the case of being used as the conductivity-imparting agent, carbon black is compounded in an amount of 10 to 80 parts by mass based on 100 parts by mass of the rubber in the rubber material. The non-conductive filler includes silica, quartz powder, titanium oxide, zinc oxide, or calcium carbonate. The crosslinking agent includes di-t-butylperoxide, 2,5-dimethyl-2,5-di(t-butylperoxy)hexane, or dicumyl peroxide.

[Surface Layer]

A first aspect of the surface layer according to the present invention includes a surface layer containing a particular urethane resin (hereinafter, also referred to as "first resin") and a particular acrylic resin (hereinafter, also referred to as "second resin").

<First Resin>

A urethane resin as the first resin has at least any one structure of the following (A) and the following (B) between adjacent two urethane linkages: (A) a structure represented by the following structural formula (1), and one or both structures selected from the group consisting of a structure represented by the following structural formula (2) and a structure represented by the following structural formula (3); (B) a structure represented by the structural formula (4):

structural formula (1)

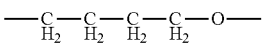

structural formula (2)

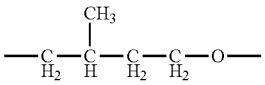

structural formula (3)

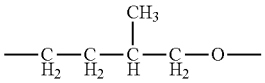

structural formula (4)

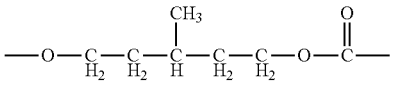

A structure or a combination of structures which the first resin should have between two urethane linkages is shown in the following Table.

TABLE

| Structural formula |
|---|
| (1) and (2) |
| (1) and (3) |
| (1), (2) and (3) |
| (4) |
| (4), (1) and (2) |
| (4), (1) and (3) |
| (4), (1), (2) and (3) |

Figure 6:
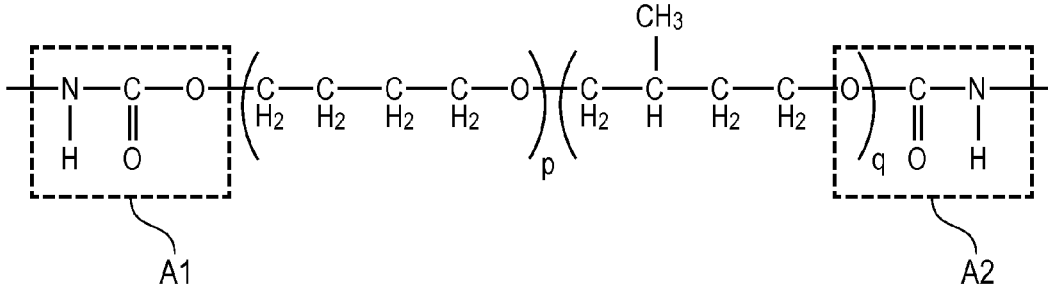
FIG. 6 is a diagram illustrating an example of the characteristic structure of a urethane resin according to the present invention.
Figure 7:
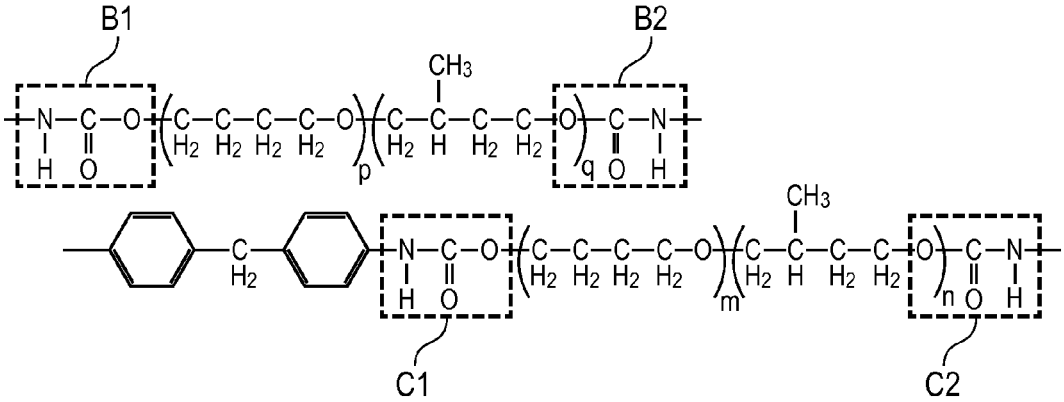
FIG. 7 is a diagram illustrating another example of the characteristic structure of the urethane resin according to the present invention.

FIG. 6 and FIG. 7 illustrate a part of a characteristic structure in the first resin.

In FIG. 6, the structure represented by the structural formula (1) and the structure represented by the structural formula (2) are sandwiched between adjacent urethane linkages A1 and A2.

In addition, in FIG. 7, the structure represented by the structural formula (1) and the structure represented by the structural formula (2) are sandwiched between adjacent urethane linkages B1 and B2, and adjacent urethane linkages C1 and C2.

The first resin contains a polyether moiety represented by a formula (1) or a formula (4) between two urethane linkages to thereby be excellent in flexibility.

In addition, the first resin has a structure in which a methyl group as a side chain is introduced between two urethane linkages, namely, at least one structure selected from the group consisting of the structures represented by the structural formulae (2) to (4), thereby suppressing stacking between polymer chains. As a result, the first resin has a remarkably low crystallinity in a low temperature region. Therefore, a developing member provided with a surface layer containing the first resin is flexible even under a low temperature environment to thereby hardly have an increased hardness, and imparts low stress to a toner even under a low temperature environment to thereby hardly cause filming.

Furthermore, the first resin has a reduced affinity of the urethane resin itself with water due to the presence of the methyl group introduced to the side chain, which enables the first resin to have a relatively low water-absorption property as a urethane resin. Furthermore, the presence of the methyl group as the side chain suppresses molecular mobility in a high temperature region. Therefore, the developing member provided with the surface layer containing the first resin has a surface whose tackiness is hardly increased even under a high-temperature and high-humidity environment, enabling the sticking of a toner on the surface of the developing roller under a high-temperature and high-humidity environment to be effectively suppressed.

The first resin can be a resin having a partial structure in which a random copolymer of the structure represented by the structural formula (1) and at least one selected from the group consisting of the structures represented by the structural formula (2) and the structural formula (3) is present between adjacent two urethane linkages. The reason for this is because an effect of reducing crystallinity in a low temperature region and an effect of suppressing molecular mobility in a high temperature region are higher. In this case, "the molar number of the structure represented by the structural formula (1)": "the sum of the molar number of the structure represented by the structural formula (2) and the molar number of the structure represented by the structural formula (3)" can be 80:20 to 50:50. If the molar ratio among the structures of the respective chemical formulae falls within the above range, a more excellent effect of suppressing toner sticking property on the surface and the peeling off of the surface layer is achieved. Since flexibility in a low temperature region is also excellent, durability is also good.

By the way, the following methods are usually used for synthesizing polyurethane.

- A one shot method in which a polyol component and a polyisocyanate component are mixed and reacted with each other.
- A method for reacting an isocyanate group terminal prepolymer obtained by reacting some polyol and isocyanate, with a chain extender such as a low molecular weight diol or a low molecular weight triol.

However, a polyetherdiol having the structure of the structural formula (1), and at least one selected from the group consisting of the structures of the structural formulae (2) and (3), or a polyetherdiol having the structure of the structural formula (4) is a low polar material. Therefore, the polyetherdiols have a low compatibility with isocyanate having a high polarity, and the system is easily microscopically phase-separated into a part having a high rate of polyol and a part having a high rate of isocyanate. The unreacted component easily remains in the part having a high rate of polyol, and the remaining unreacted polyol bleeds out to thereby cause toner sticking on the surface in some cases.

In order to reduce the amount of the remaining unreacted polyol, a high polar isocyanate is required to be excessively used, and as a result, the resultant polyurethane often has a high water-absorption rate. In addition, in all the above-described methods, the reaction between isocyanates often occurs at a high rate, resulting in a urea linkage and an allophanate linkage each having a high polarity.

Then, in the present invention, the following polyetherdiol or hydroxyl group terminal prepolymer, and the isocyanate group terminal prepolymer obtained by reacting the following polyetherdiol and aromatic diisocyanate can be reacted with each other. Thus, a difference in polarity between polyol and isocyanate can be decreased. As a result, the compatibility between polyol and isocyanate is enhanced, and isocyanate is used at a lower rate than a conventional example to provide a lower polar polyurethane. Furthermore, since the remaining unreacted polyol can be kept at a very small amount, the toner sticking on the surface due to the bleeding out of the unreacted polyol can be suppressed.

A polyetherdiol having the structure of the structural formula (1), and at least one selected from the group consisting of the structures of the structural formulae (2) and (3);

A polyetherdiol having the structure of the structural formula (4); and

A hydroxyl group terminal prepolymer obtained by reacting any of the polyetherdiols with an aromatic diisocyanate.

In the case where the hydroxyl group terminal prepolymer obtained by reacting the polyetherdiol having the structure of the structural formula (1), and at least one selected from the group consisting of the structures of the structural formula (2) and the structural formula (3), or the polyetherdiol having the structure of the structural formula (4) with an aromatic diisocyanate can be used, the number average molecular weight of the prepolymer can be 10000 or more and 15000 or less.

When using as the isocyanate group terminal prepolymer, the isocyanate content in the prepolymer can range from 3.0% by mass to 4.0% by mass.

When the molecular weight of the hydroxyl group terminal prepolymer and the isocyanate content in the isocyanate group terminal prepolymer fall within the above ranges, a polyurethane having a lower water-absorption rate can be produced and remaining of the unreacted component can be suppressed. As a result, an effect of suppressing the sticking of a toner on the surface layer and the peeling off of the surface layer from the elastic layer can be achieved at a higher level.

In addition, the first resin is more preferably a resin obtained by heat-curing a hydroxyl group terminal prepolymer of the following (a) and an isocyanate group terminal prepolymer of the following (b).

(a) A hydroxyl group terminal prepolymer having a number average molecular weight of 10000 or more and 15000 or less, obtained by reacting a polyetherdiol having a number average molecular weight of 2000 or more and 3000 or less and containing the structure of the structural formula (1) and at least one selected from the group consisting of the structures of the structural formulae (2) and (3), with an aromatic diisocyanate; (b) An isocyanate group terminal prepolymer obtained by reacting a polyetherdiol having a number average molecular weight of 2000 or more and 3000 or less and containing the structure of the structural formula (1) and at least one selected from the group consisting of the structures of the structural formulae (2) and (3), with an aromatic isocyanate.

If the polyetherdiol having a number average molecular weight of 2000 or more and 3000 or less is used as a raw material for the hydroxyl group terminal prepolymer and the isocyanate group terminal prepolymer, a polyurethane to be finally obtained can have a lower water-absorption rate. In addition, remaining of the unreacted component can be suppressed. Furthermore, since the surface layer is also excellent in strength and tackiness, durability can also be enhanced.

Polypropylene glycol and an aliphatic polyester may also be, if necessary, contained between two urethane linkages, besides the structure of the structural formula (1) and at least one selected from the group consisting of the structures of the structural formulae (2) and (3), as long as the effect of the present invention is not impaired. Examples of the aliphatic polyester include the following: an aliphatic polyesterpolyol obtained by a condensation reaction of a diol component (1,4-butanediol, 3-methyl-1,5-pentanediol, neopentyl glycol, or the like) or a triol component (trimethylolpropane or the like) and a dicarboxylic acid (adipic acid, glutaric acid, sebacic acid, or the like).

Such a polyol component may also be, if necessary, converted into a prepolymer whose chain is extended in advance by an isocyanate such as 2,4-tolylene diisocyanate (TDI), 1,4-diphenylmethane diisocyanate (MDI), or isophorone diisocyanate (IPDI).

The content rate of moieties other than the structure of the structural formula (1) and at least one selected from the group consisting of the structures of the structural formulae (2) and (3) can be 20% by mass or less in the polyurethane from the viewpoint of exerting the effect of the present invention.

In the case where the surface layer containing the first resin is provided in contact with the surface of the elastic layer containing a silicone rubber, a good adhesion property between the surface layer and the elastic layer is exhibited even if the layers are left to stand for a long period under a high-temperature and high-humidity environment. Usually, adhesion property between synthetic resins is mainly dependent on interaction between polar functional groups such as a hydrogen bond or acid-base interaction, besides a chemical linkage. However, a silicone rubber has a very low polarity, and has an inert surface. Therefore, strong interaction between polar functional groups cannot be generally expected with respect to the adhesion property between the elastic layer containing a silicone rubber and the surface layer containing a polyurethane resin. However, a good adhesion property between the surface layer containing the first resin according to the present invention and the elastic layer containing a silicone rubber is exhibited even under a stringent high-temperature and high-humidity environment. Although the detail reason for this is currently in the middle of elucidation, the present inventors presume as follows.

That is, the urethane resin having the structure represented by the structural formula (1) and at least one selected from the group consisting of the structures represented by the structural formula (2) and the structural formula (3) between adjacent urethane linkages has a very low polarity as polyurethane as compared with a conventional polyetherpolyurethane because of having the methyl group introduced to the side chain. On the other hand, a cured product of an addition-curable dimethyl silicone rubber is known to have a "spiral" molecular structure in which six siloxane (Si—O) linkages constitute one revolution, and to have a methyl group oriented outside. In other words, the surface of the polymer chain of the silicone rubber is substantially covered with a hydrophobic methyl group. Therefore, an attractive force acting between hydrophobic molecules works between the methyl group on the surface of the silicone rubber in the elastic layer according to the present invention and the methyl group as the side chain introduced between adjacent two urethane linkages in the urethane resin in the surface layer. As a result, it is considered that an excellent adhesion property between the surface layer and the elastic layer according to the present invention is exhibited.

While the surface layer containing the first resin is excellent in flexibility, the surface layer has a problem of easily resulting in C set in a high temperature region.

In view of such a problem, the present inventors have found that a second resin described later is allowed to coexist with the first resin in the surface layer to enable the problem to be improved.

Second Resin

The second resin is an acrylic resin having a structure of the following structural formula (5) and having a glass transition point Tg of 20° C. or higher and 120° C. or lower.

structural formula (5)

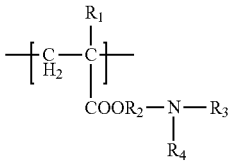

In the formula (5), $R_1$ represents a hydrogen atom or a methyl group. $R_2$ represents an alkylene group having 1 to 4 carbon atoms. In addition, $R_3$ and $R_4$ each independently represent an alkyl group having 1 or 2 carbon atoms.

Then, the second resin is allowed to be contained in the surface layer together with the first resin, and thus the surface layer according to the first aspect can be a surface layer that enables the occurrence of C set in a high temperature region to be effectively suppressed while maintaining flexibility for enabling the sticking of a toner and the like on the surface of the surface layer to be effectively suppressed owing to the inclusion of the first resin. The reason for this is presumed as follows.

The first resin has a relatively low polarity, and thus is well compatible with the second resin. That is, the first resin and the second resin are highly compatible with each other in the surface layer. As a result, a polar functional group in the acrylic resin, namely, a tertiary amino group ($—NR_3R_4$) interacts with a urethane linkage part of the urethane resin while forming a hydrogen bond with the part, producing a pseudo-crosslinked structure. Herein, the second resin is a resin having a high glass transition point Tg, and thus the pseudo-crosslinked structure part configured by the second resin results in no large change in hardness even in a high temperature region. Therefore, the surface layer containing the first resin and the second resin is considered to be flexible due to the presence of the first resin and to hardly result in C set even in a high temperature region due to the pseudo-crosslinked structure formed by the second resin.

Herein, the glass transition temperature Tg of the second resin is 20° C. or higher and 120° C. or lower. The Tg of the second resin falls within the above range, thereby exerting an effect of well suppressing C set of the surface layer containing the first resin and the second resin. In addition, the increase in hardness of the surface layer under low-temperature and low-humidity can be suppressed.

The molar ratio of the structure of the structural formula (5) in the second resin can be 50 to 100%. Specific examples of a monomer for giving the structure of the structural formula (5) in the second resin include the following: N,N-dimethylaminomethyl(meth)acrylate, N,N-diethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminobutyl(meth)acrylate, and N,N-diethylaminobutyl(meth)acrylate. Herein, the "(meth)acrylate" means methacrylate or acrylate.

In order to adjust the compatibility of the second resin with the first resin and the Tg of the second resin, the second resin may also be a copolymer further having other structure than the structure of the structural formula (5). Specific examples of a monomer capable of forming the copolymer include the following: methyl(meth)acrylate, ethyl(meth)acrylate, n-butyl(meth)acrylate, tert-butyl(meth)acrylate, iso-butyl(meth)acrylate, n-amyl(meth)acrylate, n-hexyl(meth)acrylate, cyclohexyl(meth)acrylate, styrene, benzyl(meth)acrylate, phenyl(meth)acrylate, 2-ethylhexyl(meth)acrylate, n-octyl(meth)acrylate, iso-octyl(meth)acrylate, and isobornyl(meth)acrylate.

The number average molecular weight of the second resin can be 10000 or more and 70000 or less in terms of both of compatibility and flexibility.

In addition, the content of the acrylic resin of the second resin in the surface layer can be 1 part by mass or more and 20 parts by mass or less based on 100 parts by mass of the first resin in the surface layer.

A second aspect of the surface layer according to the present invention includes one containing a reaction product of a polyol having at least one structure selected from the group consisting of the following (A) and (B), an acrylic resin having a structure represented by the following structural formula (6) and having a glass transition point Tg of 50° C. or higher and 120° C. or lower, and an isocyanate compound: (A) a structure represented by the following structural formula (1), and one or both structures selected from the group consisting of a structure represented by the following structural formula (2) and a structure represented by the following structural formula (3); and (B) a structure represented by the following structural formula (4):

structural formula (1)

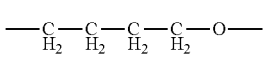

structural formula (2)

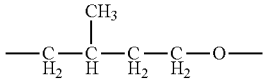

structural formula (3)

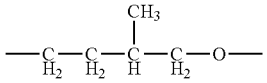

structural formula (4)

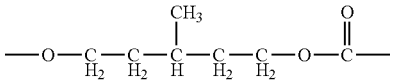

structural formula (6)

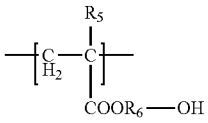

wherein, $R_5$ represents a hydrogen atom or a methyl group, and $R_6$ represents an alkylene group having 1 to 4 carbon atoms.

That is, the polyol having at least one structure selected from the group consisting of the above (A) and (B) is reacted with an isocyanate group of the isocyanate compound to form a urethane linkage, thereby producing a urethane resin having at least one structure selected from the group consisting of the above (A) and (B) between adjacent two urethane linkages.

On the other hand, the acrylic resin having the structure represented by the structural formula (6) and having a glass transition temperature Tg of 50° C. or higher and 120° C. or lower produces a urethane linkage formed by reacting a hydroxyl group (—OH) in the structural formula (6) with an isocyanate group (—NCO), thereby producing a urethane resin in which an acrylic resin not having the structures represented by the structural formulae (1) to (4) but having a partial structure of the structural formula (6), and having a glass transition temperature Tg of 50 to 120° C. is incorporated between adjacent two urethane linkages.

In the case where the acrylic resin having a glass transition temperature Tg of 50° C. to 120° C. is incorporated between two urethane linkages as the partial structure of the urethane resin having at least one structure selected from the group consisting of (A) and (B), the urethane resin is simultaneously provided with a flexible structure part derived from the structural formulae (1) to (4) and a rigid structure part derived from the acrylic resin having a Tg of 50° C. to 120° C.

On the other hand, even in the case where the urethane resin in which the acrylic resin having a glass transition temperature Tg of 50° C. to 120° C. is incorporated between two urethane linkages (hereinafter, also referred to as "acrylic urethane resin") and the urethane resin having at least one structure selected from the group consisting of (A) and (B) between two urethane linkages are each independently present in the surface layer, it is considered that an unreacted hydroxyl group usually remains in the structure derived from the structural formula (6) in the acrylic urethane resin. Therefore, it is considered that the unreacted hydroxyl group forms a hydrogen bond together with a urethane linkage of the urethane resin having at least one structure selected from the group consisting of (A) and (B) between two urethane linkages to configure the pseudo-crosslinked structure described above. As a result, it is considered that the surface layer simultaneously satisfies flexibility for enabling toner filming to be suppressed, and elasticity for suppressing the occurrence of C set.

In the acrylic resin containing the structure of the structural formula (6) according to the present aspect, the molar ratio of the constituent unit represented by the structural formula (6) in all the constituent units of the acrylic resin can be 10 to 20%.

Specific examples of a monomer for giving the structure of the structural formula (6) in the acrylic resin include the following.

Hydroxymethyl(meth)acrylate, hydroxyethyl(meth)acrylate, hydroxypropyl(meth)acrylate, and hydroxybutyl(meth) acrylate are exemplified.

In addition, the Tg of the acrylic resin contained in the surface layer of the present invention and having the structure of the structural formula (6) is 50° C. or higher and 120° C. or lower. The Tg of the acrylic resin falls within the above range, thereby imparting to the reaction product excellent flexibility and high impact resilience. In addition, the number average molecular weight of the acrylic resin can be 10000 or more and 70000 or less in terms of both of compatibility and flexibility.

For the purpose of adjusting the Tg, the acrylic resin for use in synthesizing the urethane resin according to the second aspect may also be a copolymer further having a structure other than the structure of the structural formula (6). Specific examples of a monomer capable of forming the copolymer include the following. Herein, the "(meth)acrylate" means acrylate or methacrylate.

Methyl(meth)acrylate, ethyl(meth)acrylate, n-butyl(meth) acrylate, tert-butyl(meth)acrylate, iso-butyl(meth)acrylate, n-amyl(meth)acrylate, n-hexyl(meth)acrylate, cyclohexyl (meth)acrylate, styrene, benzyl(meth)acrylate, phenyl(meth) acrylate, 2-ethylhexyl(meth)acrylate, n-octyl(meth)acrylate, iso-octyl(meth)acrylate, isobornyl(meth)acrylate, and the like are exemplified. Among these monomers, methyl(meth) acrylate or styrene can be in particular used for an acrylic structure part in the urethane resin according to the second aspect from the viewpoint of allowing the urethane resin to have a relatively high Tg of 50° C. to 120° C.

The isocyanate compound to be reacted with the polyol and the acrylic resin is not particularly limited, but aliphatic polyisocyanates such as ethylene diisocyanate and 1,6-hexamethylene diisocyanate (HDI), alicyclic polyisocyanates such as isophorone diisocyanate (IPDI), cyclohexane 1,3-diisocyanate, and cyclohexane 1,4-diisocyanate, and aromatic isocyanates such as 2,4-tolylene diisocyanate, 2,6-tolylene diisocyanate (TDI), 4,4-diphenylmethane diisocyanate (MDI), polymeric diphenylmethane diisocyanate, xylylene diisocyanate, and naphthalene diisocyanate, as well as copolymerized products and isocyanurate products, TMP adduct products and biuret products thereof, and their block products can be used.

Among these isocyanate compounds, aromatic isocyanates such as tolylene diisocyanate, diphenylmethane diisocyanate, and polymeric diphenylmethane diisocyanate are more suitably used.

A more specific configuration of the surface layer according to the second aspect includes a surface layer containing a urethane resin, wherein the urethane resin has a partial structure having at least one structure selected from the group consisting of the following (A) and (B) between adjacent two urethane linkages, and the urethane resin has a partial structure having a structure of the following (C) and not having the structures of the following (A) and (B) between adjacent two urethane linkages.

(A) A structure represented by the following structural formula (1), and one or both structures selected from the group consisting of a structure represented by the following structural formula (2) and a structure represented by the following structural formula (3);

structural formula (1)

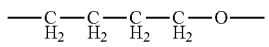

structural formula (2)

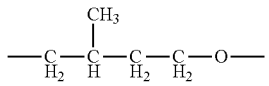

structural formula (3)

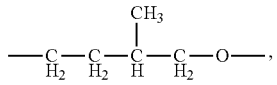

(B) A structure represented by the following structural formula (4):

structural formula (4)

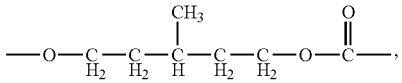

(C) A structure represented by the following structural formula (7), and one or both structures selected from the group consisting of a structure represented by the following structural formula (8) and a structure represented by the following structural formula (9);

structural formula (7)

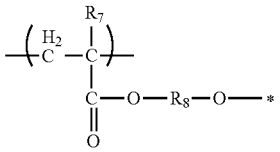

wherein, $R_7$ represents a hydrogen atom or an alkyl group having 1 to 3 carbon atoms, $R_8$ represents an alkylene group having 1 to 4 carbon atoms, and symbol "*" represents a linking position to a carbon atom constituting a urethane linkage.

structural formula (8)

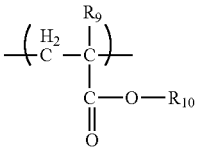

wherein, $R_9$ represents a hydrogen atom or a methyl group, and $R_{10}$ represents an alkyl group having 1 or 2 carbon atoms.

structural formula (9)

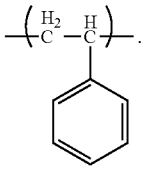

The structural formula (7) represents the structure derived from the structural formula (6), and the structural formulae (8) to (9) represent a structural unit for allowing the acrylic resin to have a relatively high Tg of 50° C. to 120° C. In the (C), the ratio of the total of the molar numbers of the structure represented by the structural formula (8) and the structure represented by the structural formula (9) to the sum of the molar numbers of the structure represented by the structural formula (7), the structure represented by the structural formula (8), and the structure represented by the structural formula (9) can be 50% or more.

Figure 8:
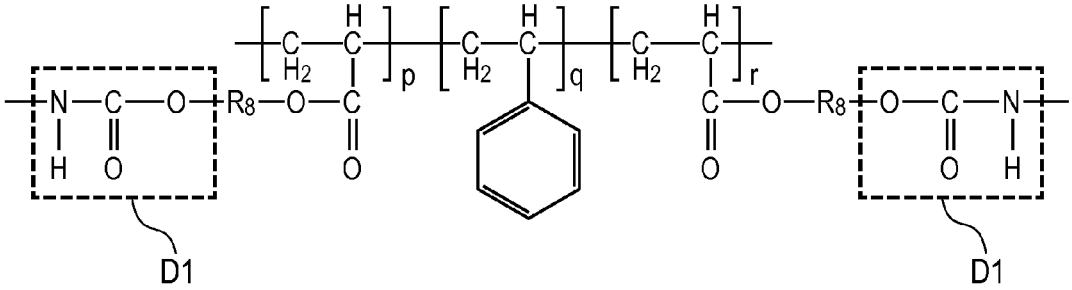
FIG. 8 is a diagram illustrating one example of a partial structure in the urethane resin according to the present invention.

Specific examples of the partial structure having the structure of the (C) and not having the structures of the (A) and (B) between adjacent two urethane linkages D1 are shown in FIG. 8.

In addition, the surface layer according to the second aspect also exhibits a good adhesion property with the elastic layer containing a silicone rubber in the case of being provided in contact with the surface of the elastic layer, as described above, even in the case where the surface layer and the elastic layer are left to stand for a long period under a high-temperature and high-humidity environment. The reason for this is considered to be the same as the case of the surface layer according to the first aspect.

Conductive Agent

The surface layer 4 according to the present invention can have conductivity. A conductivity-imparting means includes addition of an ion conductive agent or conductive fine particles, but conductive fine particles which are inexpensive and whose resistance is less varied depending on environments are suitably used, and in particular carbon black can be used in terms of conductivity-imparting property and reinforcing property. In terms of properties of the conductive fine particles, carbon black having a primary particle size of 18 nm or more and 50 nm or less and a DBP oil absorption amount of 50 ml/100 g or more and 160 ml/100 g or less can be used because of having a good balance among conductivity, hardness, and dispersibility. The content rate of the conductive fine particles can be 10 parts by mass or more and 30 parts by mass or less based on 100 parts by mass of the resin component forming the surface layer.

Surface-Roughening Particles

In the case where the surface of the developing roller is required to be roughened, fine particles for controlling roughness may also be added to the surface layer 4. The fine particles for controlling roughness can have a volume average particle size of 3 to 20 m.

In addition, the amount of the particles to be added to the surface layer can be 10 to 100 parts by mass based on 100 parts by mass of the resin solid content of the surface layer. Fine particles made of a urethane resin, a polyester resin, a polyether resin, a polyamide resin, an acrylic resin, or a phenol resin can be used for the fine particles for controlling roughness.

Method for Forming Surface Layer

A method for forming the surface layer 4 is not particularly limited, and the method includes spraying, dipping, or roll coating by a coating material. A dip coating method in which a coating material is overflowed from the upper end of a dipping bath, described in Japanese Patent Application Laid-Open No. S57-5047, is simple and excellent in production stability as the method for forming the surface layer.

Figure 4:
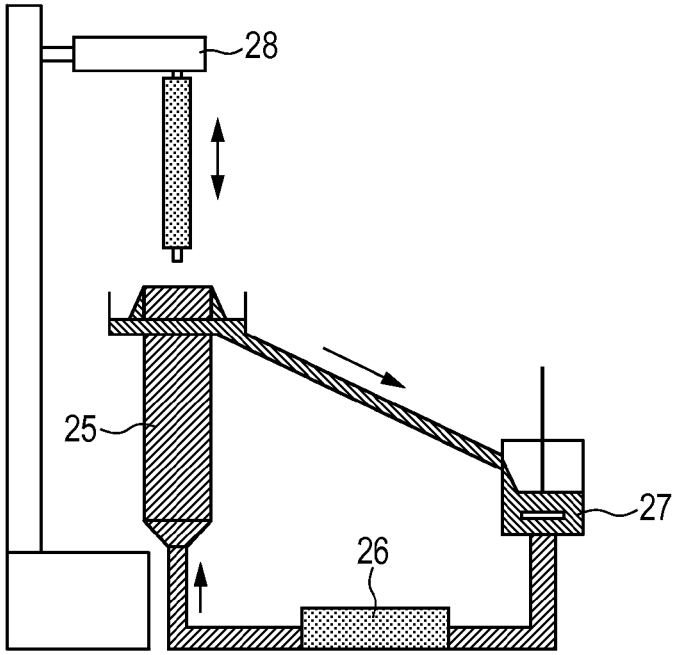
FIG. 4 is a schematic view illustrating one example of a liquid circulation type dip coating apparatus.

FIG. 4 is a schematic view of a dip coating apparatus. Reference numeral 25 denotes a cylindrical dipping bath, and the bath has a slightly larger inner diameter than the outer diameter of the developing roller, and has a depth exceeding the length of the developing roller in the axial direction. The outer periphery of the upper edge of the dipping bath 25 is provided with an annular liquid receiving portion that is connected to a stirring tank 27. In addition, the bottom portion of the dipping bath 25 is connected to the stirring tank 27. A coating material in the stirring tank 27 is sent into the bottom portion of the dipping bath 25 by a liquid sending pump 26. The coating material is overflowed from the upper end portion of the dipping bath, and returned to the stirring tank 27 via the liquid receiving portion on the outer periphery of the upper edge of the dipping bath 25. The mandrel 2 provided with the elastic layer 3 is vertically secured to an elevating apparatus 28, and dipped in and pulled up from the dipping bath 25 to thereby form the surface layer 4.

The developing roller of the present invention can be applied to any apparatus such as a non-contact type developing apparatus and a contact type developing apparatus using a magnetic one-component developer or a non-magnetic one-component developer, and a developing apparatus using a two-component developer.

Process Cartridge, Electrophotographic Apparatus

A process cartridge of the present invention is provided with an electrophotographic photosensitive member arranged abutting the developing roller of the present invention, the process cartridge being configured to be detachable to a main body of an electrophotographic apparatus. In addition, an electrophotographic apparatus of the present invention is provided with an electrophotographic photosensitive member arranged abutting the developing roller of the present invention.

The process cartridge and the electrophotographic apparatus of the present invention are not limited to a copier, a facsimile, or a printer as long as having the developing roller of the present invention.

Figure 2:
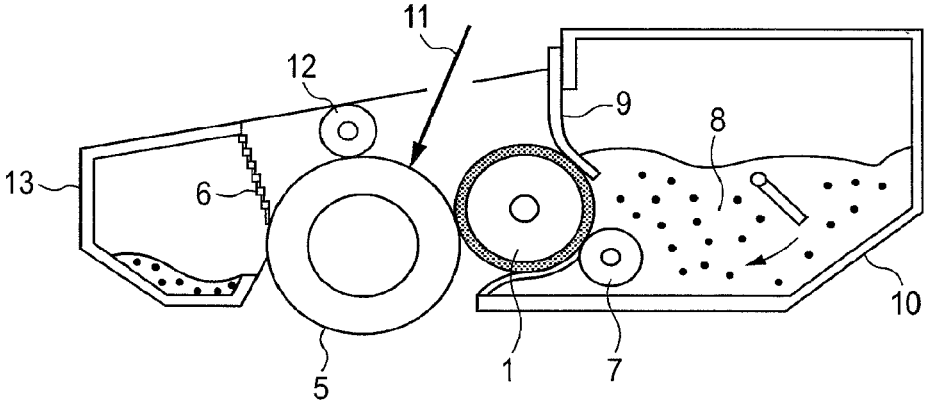
FIG. 2 is a schematic configuration view illustrating one example of a process cartridge of the present invention.

As one example for the process cartridge and the electrophotographic apparatus of the present invention on which the developing roller of the present invention is mounted, a printer using a non-magnetic one-component developing process will be described below. In FIG. 2, a developing apparatus 10 is provided with a developing container accommodating a non-magnetic toner 8 as a one-component toner, and the developing roller 1 positioned at an opening extending in the longitudinal direction in the developing container and disposed opposite to a photosensitive member 5, and an electrostatic latent image on the photosensitive member 5 is developed to form a toner image. In FIG. 2, numeral reference 6 denotes a cleaning member, numeral reference 7 denotes a toner supplying roller, numeral reference 9 denotes a regulating blade, numeral reference 11 denotes laser light, numeral reference denotes a charging member, and numeral reference 13 denotes a cleaning apparatus.

Figure 3:
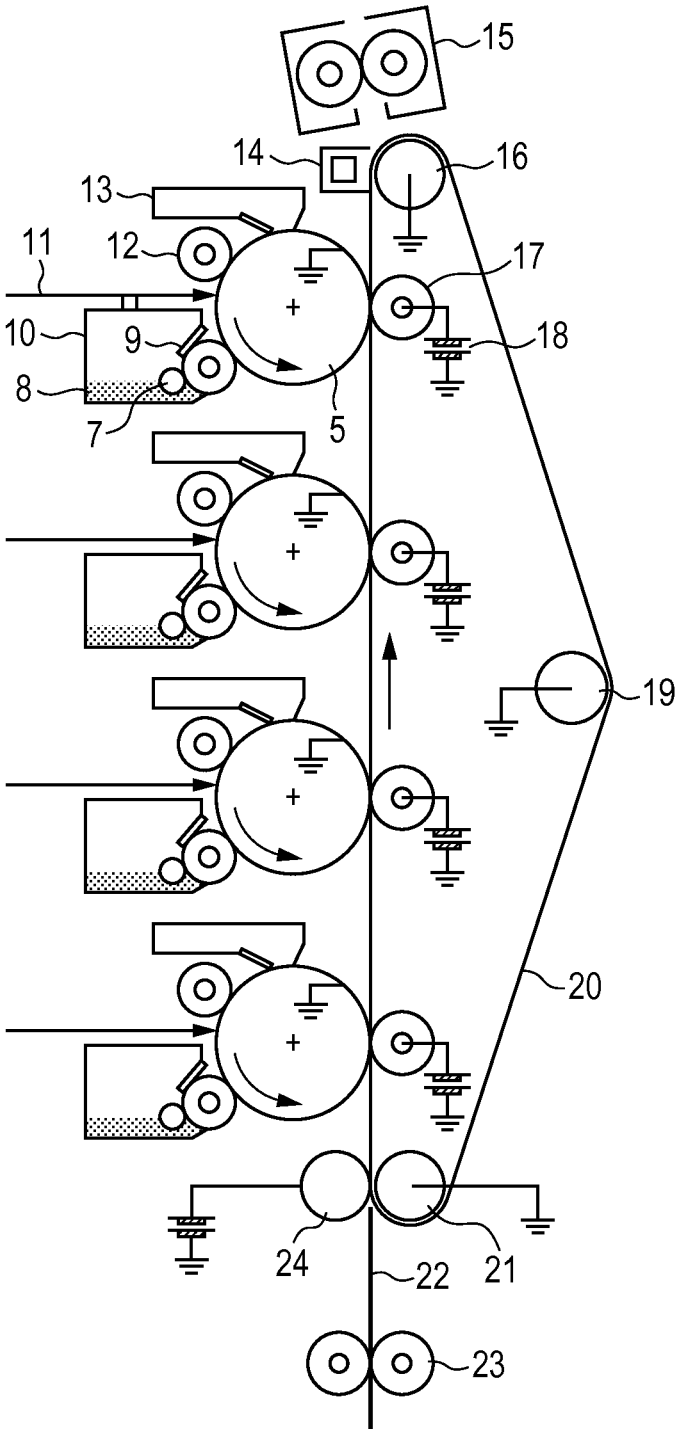
FIG. 3 is a schematic configuration view illustrating one example of an electrophotographic apparatus of the present invention.

As illustrated in FIG. 3, the printer is provided with the photosensitive member 5 to be rotated by a rotation mechanism not illustrated. The charging member 12 for charging the surface of the photosensitive member 5 to a predetermined polarity and potential, and an image exposing apparatus, not illustrated, for subjecting the charged surface of the photosensitive member 5 to image exposure to form an electrostatic latent image are arranged around the photosensitive member 5. Furthermore, the developing apparatus 10 having the developing roller 1 of the present invention for allowing a toner to adhere on the formed electrostatic latent image to develop the image is arranged around the photosensitive member 5. Furthermore, the cleaning apparatus 13 for cleaning the upper portion of the photosensitive member 5 after transferring a toner image to paper 22, is provided.

A fixing apparatus 15 for fixing the transferred toner image on the paper 22 is arranged on a route for conveying the paper 22. In FIG. 3, numeral 14 denotes a charging apparatus for cleaning, numeral 16 denotes a driving roller, numeral 17 denotes a transfer roller, and numeral 18 denotes a bias power supply. In addition, numeral 19 denotes a tension roller, numeral 20 denotes a transfer conveying belt, numeral 21 denotes a driven roller, numeral 23 denotes a paper feeding roller, and numeral 24 denotes an adsorption roller.

EXAMPLES

Hereinafter, specific Examples and Comparative Examples according to the present invention will be shown.

—Preparation of Mandrel 2—

A primer (trade name, DY35-051; produced by Dow Corning Toray Co., Ltd.) was applied to a core made of SUS304, having a diameter of 6 mm, and baked. The resultant was used as the mandrel 2.

—Preparation of Elastic Layer 3—

The prepared mandrel 2 was placed on a mold, and an addition type silicone rubber composition in which the following materials were mixed was injected to a cavity formed in the mold.

Liquid silicone rubber material (trade name, SE6724A/B; produced by Dow Corning Toray Co., Ltd.): 100 parts by mass, Carbon black (trade name, Tokablack #4300; produced by Tokai Carbon Co., Ltd.): 15 parts by mass, Silica powder as heat resistance-imparting agent: 0.2 parts by mass, Platinum catalyst: 0.1 parts by mass.

Subsequently, the mold was heated to vulcanize and cure the silicone rubber at 150° C. for 15 minutes, and released, and thereafter the resultant was further heated at 180° C. for 1 hour to complete a curing reaction, thereby providing an elastic layer having a diameter of 12 mm on the outer periphery of the mandrel 2.

—Preparation of Surface Layer 4—

Hereinafter, a synthesis example for obtaining a surface layer made of a urethane resin of the present invention will be shown.

[Measurement of Number Average Molecular Weight]

An apparatus and conditions used in measuring the number average molecular weight (Mn) in the present Examples are as follows.

Measuring instrument: HLC-8120 GPC (trade name, manufactured by Tosoh Corporation); Column: TSKgel SuperHZMM (trade name, manufactured by Tosoh Corporation)×2; Solvent: tetrahydrofuran (THF); Temperature: 40° C.; Flow speed of THF: 0.6 ml/min; Herein, a measurement sample was a 0.1% by mass THF solution. Furthermore, an RI (refractive index) detector was used as a detector to perform the measurement.

TSK standard polystyrenes (trade name, A-1000, A-2500, A-5000, F-1, F-2, F-4, F-10, F-20, F-40, F-80, and F-128; produced by Tosoh Corporation) were used as standard specimens for creating a calibration curve, thereby creating a calibration curve. The number average molecular weight was determined from the retention time of the measurement sample obtained based on the calibration curve.

[Measurement of Tg]

A differential scanning calorimeter DSC8230L (trade name, manufactured by Rigaku Corporation) was used for a measuring instrument for measuring the Tg of the resin component in the present Examples.

(Synthesis of Polyetherdiol A-1)

A mixture of 230.7 g (3.2 mol) of dry tetrahydrofuran and 68.9 g (0.8 mol) of dry 3-methyltetrahydrofuran (molar mixing ratio 80/20) was kept at a temperature of 10° C. in a reaction vessel. Thereto, 13.1 g of 70% perchloric acid and 120 g of acetic anhydride were added and reacted for 2.5 hours. Then, the reaction mixture was poured into 600 g of a 20% aqueous sodium hydroxide solution, and purified. The remaining water and solvent component were removed under reduced pressure to provide 218 g of a liquid polyetherdiol A-1. The hydroxyl value was 57.0 mgKOH/g, and the number average molecular weight was about 2000.

(Synthesis of Hydroxyl Group Terminal Urethane Prepolymer A-2)

In 50.0 parts by mass of methyl ethyl ketone, 28.4 parts by mass of diphenylmethane diisocyanate (trade name, Cosmonate MDI: produced by Mitsui Chemicals, Inc.) was dissolved under a nitrogen atmosphere in a reaction vessel. Then, a solution of 200.0 g of the polyetherdiol A-1 in 178.4 parts by mass of methyl ethyl ketone was gradually dropped thereto while the temperature in the reaction vessel was kept at 65° C.

After the completion of dropping, the mixture was reacted at a temperature of 75° C. for 3 hours. The resultant reaction mixture was cooled to room temperature to provide 226 g of a hydroxyl group terminal urethane prepolymer A-2. The hydroxyl value was 6.0 mgKOH/g, and the number average molecular weight was about 15000.

(Synthesis of Hydroxyl Group Terminal Urethane Prepolymer A-3)

A hydroxyl group terminal urethane prepolymer A-3 (244 g) was obtained under the same conditions except that the polyetherdiol A-1 was changed to a polyesterdiol (trade name, Kuraray Polyol P-2010; produced by Kuraray Co., Ltd.). The hydroxyl value was 6.2 mgKOH/g, and the number average molecular weight was 15000.

The resultant respective polyols are shown in Table 1.

TABLE 1

| Example | Type of polyol | Formula of contained structure |
|---|---|---|
| A-1 | Polyether polyol | (1) (2) (3) |
| A-2 | Hydroxyl terminal polyurethane polyol | (1) (2) (3) |
| A-3 | Hydroxyl terminal polyurethane polyol | (4) |

(Synthesis of Isocyanate Group Terminal Prepolymer B-1)

In 80.0 parts by mass of methyl ethyl ketone, 76.7 parts by mass of polymeric MDI (trade name, Millionate MT; produced by Nippon Polyurethane Industry Co., Ltd.) was dissolved under a nitrogen atmosphere in a reaction vessel. Then, a solution of 200.0 g of the polyetherdiol A-1 in 70.0 parts by mass of methyl ethyl ketone was gradually dropped thereto while the temperature in the reaction vessel was kept at 65° C. After the completion of dropping, the mixture was reacted at a temperature of 65° C. for 2 hours. The resultant reaction mixture was cooled to room temperature to provide 229 g of an isocyanate group terminal urethane prepolymer B-1 having an isocyanate group content of 4.7% and a solid content of 65%.

(Synthesis of Isocyanate Group Terminal Prepolymer B-2)

An isocyanate group terminal urethane prepolymer B-(233 g) having an isocyanate group content of 4.8% and a solid content of 65% was obtained in the same manner as in the synthesis of B-1 except that the polyetherdiol A-1 was changed to polyesterdiol (trade name, Kuraray Polyol P-2010; produced by Kuraray Co., Ltd.).

(Synthesis of Isocyanate Group Terminal Prepolymer B-3)

In 80.0 parts by mass of methyl ethyl ketone, 69.6 parts by mass of tolylene diisocyanate (TDI) (trade name, Cosmonate 80; produced by Mitsui Chemicals, Inc.) was dissolved under a nitrogen atmosphere in a reaction vessel. Then, a solution of 200.0 g of a propylene glycol-based polyol (trade name, Excenol 1030; produced by Sanyo Chemical Industries, Ltd.) in 70.0 parts by mass of methyl ethyl ketone was gradually dropped thereto while the temperature in the reaction vessel was kept at 65° C. After the completion of dropping, the mixture was reacted at a temperature of 65° C. for 2 hours. The resultant reaction mixture was cooled to room temperature to provide 244 g of an isocyanate group terminal urethane prepolymer B-3 having an isocyanate group content of 4.3% and a solid content of 65%.

TABLE 2

| Example | Type of isocyanate | Formula of contained structure |
|---|---|---|
| B-1 | Polymeric MDI | (1) (2) (3) |
| B-2 | Polymeric MDI | (4) |
| B-3 | TDI | — |

(Synthesis of Acrylic Resin C-1)

To a reaction vessel equipped with a stirring apparatus, a thermometer, a reflux pipe, a dropping apparatus, and a nitrogen gas introduction pipe, 300.0 parts by mass of dry methyl ethyl ketone was charged, heated to a temperature of 87° C. under a nitrogen gas stream, and heated under reflux. Then, a mixture of 100.0 parts by mass of dimethylaminobutyl acrylate and 0.2 parts by mass of an initiator (trade name, Kayaester O; produced by Kayaku Akzo Corporation) was gradually dropped thereto over 1 hour, and the mixture was further heated under reflux for 3 hours while the mixture was kept at a temperature of 87° C. Then, the temperature was lowered to 50° C., and then 200.0 parts by mass of methyl ethyl ketone was distilled off under reduced pressure. The resultant was left to stand to be cooled to room temperature, providing an acrylic resin C-1. The Tg was 20° C.

(Synthesis of Acrylic Resins C-2 to C-17)

Acrylic resins C-2 to C-17 were obtained in the same manner as in the synthesis example of the acrylic resin C-1 except that the types of monomers and the molar mixing ratio were changed as shown in Table 3.

TABLE 3

| | Monomer 1 | | Monomer 2 | | Monomer 3 | | |
|---|---|---|---|---|---|---|---|
| No. | Type of monomer | % by mole | Type of monomer | % by mole | Type of monomer | % by mole | Tg (° C.) |
| C-1 | Dimethylaminobutyl acrylate | 100 | — | — | — | — | 20 |
| C-2 | Dimethylaminoethyl methacrylate | 50 | Methyl methacrylate | 50 | — | — | 60 |
| C-3 | Dimethylaminomethyl methacrylate | 50 | Styrene | 50 | — | — | 120 |
| C-4 | Dimethylaminoethyl methacrylate | 30 | Methyl methacrylate | 70 | — | — | 60 |
| C-5 | Dimethylaminoethyl methacrylate | 70 | Methyl methacrylate | 30 | — | — | 60 |
| C-6 | | 70 | Styrene | 30 | — | — | 100 |
| C-7 | 4-Hydroxybutyl acrylate | 50 | Methyl methacrylate | 50 | — | — | 50 |
| C-8 | 2-Hydroxyethyl methacrylate | 30 | Methyl methacrylate | 70 | — | — | 90 |
| C-9 | Hydroxymethyl methacrylate | 30 | Styrene | 80 | — | — | 120 |
| C-10 | 2-Hydroxyethyl methacrylate | 40 | Methyl methacrylate | 60 | — | — | 60 |
| C-11 | Dimethylaminoethyl methacrylate | 30 | 2-Hydroxyethyl methacrylate | 30 | Methyl methacrylate | 40 | 90 |
| C-12 | | 30 | | 30 | Styrene | 40 | 120 |
| C-13 | Methyl methacrylate | 90 | Styrene | 10 | — | — | 60 |
| C-14 | Dimethylaminoethyl methacrylate | 40 | Lauryl methacrylate | 70 | — | — | 5 |
| C-15 | Dimethylaminomethyl methacrylate | 5 | Styrene | 95 | — | — | 150 |

TABLE 3-continued

| | Monomer 1 | | Monomer 2 | | Monomer 3 | | |
|---|---|---|---|---|---|---|---|
| No. | Type of monomer | % by mole | Type of monomer | % by mole | Type of monomer | % by mole | Tg (° C.) |
| C-16 | 2-Hydroxyethyl methacrylate | 40 | Lauryl methacrylate | 60 | — | — | 40 |
| C-17 | Hydroxymethyl methacrylate | 5 | Styrene | 95 | — | — | 150 |

Example 1

Hereinafter, a method for manufacturing the developing roller of the invention of the present application will be described.

As materials for the surface layer 4, 109.0 parts by mass of the isocyanate group terminal prepolymer B-1, 16.0 parts by mass of the acrylic resin C-1, and 32.0 parts by mass of carbon black (trade name, MA230; produced by Mitsubishi Chemical Corporation) based on 100.0 parts by mass of the polyol A-1 were stirred and mixed.

Then, the resultant was dissolved in and mixed with methyl ethyl ketone (hereinafter MEK) so that the total solid content ratio was 30% by mass, and then uniformly dispersed by a sand mill to provide a coating material 1 for forming a surface layer. Then, the coating material was diluted with MEK so as to have a viscosity of 10 to 13 cps, and then dip coated on the elastic layer and then dried. The resultant was further subjected to a heat treatment at a temperature of 150° C. for 1 hour to provide a surface layer having a film thickness of about 20 μm on the outer periphery of the elastic layer, thereby providing a developing roller of Example 1.

Example 4

As materials for the surface layer 4, 107.0 parts by mass of the isocyanate group terminal prepolymer B-1, 15.9 parts by mass of the acrylic resin C-4, and 31.8 parts by mass of carbon black (trade name, MA230; produced by Mitsubishi Chemical Corporation) based on 100.0 parts by mass of a polyesterdiol (trade name, Kuraray Polyol P-2010; produced by Kuraray Co., Ltd.) were stirred and mixed. After that, the same manner as in Example 1 was performed to provide a developing roller of Example 4.

Example 7

As materials for the surface layer 4, 19.1 parts by mass of the isocyanate group terminal prepolymer B-1, 6.1 parts by mass of the acrylic resin C-1, and 12.1 parts by mass of carbon black (trade name, MA230; produced by Mitsubishi Chemical Corporation) based on 100.0 parts by mass of the hydroxyl group terminal urethane prepolymer A-2 were stirred and mixed. After that, the same manner as in Example 1 was performed to provide a developing roller of Example 7.

Example 13

As materials for the surface layer 4, 68.8 parts by mass of polymeric MDI (trade name, Millionate MR-200; produced by Nippon Polyurethane Industry Co., Ltd.), 12.5 parts by mass of the acrylic resin C-2, and 24.9 parts by mass of carbon black (trade name, MA230; produced by Mitsubishi Chemical Corporation) based on 100.0 parts by mass of the polyol A-1 were stirred and mixed. After that, the same manner as in Example 1 was performed to provide a developing roller of Example 13.

Examples 2, 3, 5, 6, 8 to 12, and 14 to 26

As materials for the surface layer 4, an isocyanate group terminal prepolymer and an acrylic resin, and carbon black in respective amounts based on 100.0 parts by mass of each of the polyols, as shown in Table 4, were stirred and mixed. After that, the same manner as in Example 1 was performed to provide a developing roller of each of Examples 2, 3, 5, 6, 8 to 12, and 14 to 26.

It can be confirmed from the analysis using pyrolysis GC/MS, FT-IR, 13C nuclear solid state NMR, and the like that the surface layer of the present invention has the structure represented by the structural formula (1), and one or both structures selected from the group consisting of the structures represented by the structural formula (2) and the structural formula (3), or the structure represented by the structural formula (4).

Then, it has been confirmed from the analysis results by pyrolysis GC/MS and FT-IR that each of the surface layers obtained in Examples has the structure represented by the structural formula (1), and one or both structures selected from the group consisting of the structure represented by the following structural formula (2) and the structure represented by the following structural formula (3) or the structural formula (4).

TABLE 4

| | Surface layer | | | | | |
|---|---|---|---|---|---|---|
| | | Isocyanate | | Carbon black | Acryl | |
| Example | Polyol Type | Type | Compounded amount based on 100 g of polyol (g) | Compounded amount based on 100 g of polyol (g) | Type | Compounded amount based on 100 g of polyol (g) |
| 1 | A-1 | B-1 | 109.0 | 32.0 | C-1 | 16.0 |
| 2 | | | | | C-2 | |
| 3 | | | | | C-3 | |

TABLE 4-continued

| | Surface layer | | | | | |
|---|---|---|---|---|---|---|
| | | Isocyanate | | Carbon black | Acryl | |
| Example | Polyol Type | Type | Compounded amount based on 100 g of polyol (g) | Compounded amount based on 100 g of polyol (g) | Type | Compounded amount based on 100 g of polyol (g) |
| 4 | "P-2010" | | 107.0 | 31.8 | C-4 | 15.9 |
| 5 | | | | | C-5 | |
| 6 | | | | | C-6 | |
| 7 | A-2 | | 19.1 | 12.1 | C-1 | 6.1 |
| 8 | | | | | C-2 | |
| 9 | | | | | C-3 | |
| 10 | "P-2010" | B-2 | 104.8 | 31.5 | C-2 | 15.8 |
| 11 | A-3 | | 19.3 | 12.1 | | 6.1 |
| 12 | A-2 | B-3 | 20.9 | 12.3 | | 6.2 |
| 13 | A-1 | "MR200" | 68.8 | 24.9 | | 12.5 |
| 14 | A-1 | B-1 | 109.0 | 32.0 | C-7 | 16.0 |
| 15 | | | | | C-8 | |
| 16 | | | | | C-9 | |
| 17 | "P-2010" | | 107.0 | 31.8 | C-7 | 15.9 |
| 18 | | | | | C-8 | |
| 19 | | | | | C-9 | |
| 20 | A-2 | | 19.1 | 12.1 | C-10 | 6.1 |
| 21 | | | | | C-11 | |
| 22 | | | | | C-12 | |
| 23 | "P-2010" | B-2 | 104.8 | 31.5 | C-8 | 15.8 |
| 24 | A-3 | | 19.3 | 12.1 | | 6.1 |
| 25 | A-2 | B-3 | 20.9 | 12.3 | | 6.2 |
| 26 | "P-2010" | "MR200" | 67.6 | 24.8 | | 12.4 |

Comparative Example 1

As materials for the surface layer 4, 26.8 parts by mass of polymeric MDI (trade name, Millionate MR-200; produced by Nippon Polyurethane Industry Co., Ltd.), 11.0 parts by mass of the acrylic resin C-2, and 21.9 parts by mass of carbon black (trade name, MA230; produced by Mitsubishi Chemical Corporation) based on 100.0 parts by mass of polytetramethylene glycol (trade name, PTMG3000; produced by Sanyo Chemical Industries, Ltd.) were stirred and mixed. After that, the same manner as in Example 1 was performed to provide a developing roller of Comparative Example 1.

Comparative Example 2

As materials for the surface layer 4, 40.6 parts by mass of polymeric MDI (trade name, Millionate MR-200; produced by Nippon Polyurethane Industry Co., Ltd.), 11.5 parts by mass of the acrylic resin C-2, and 22.9 parts by mass of carbon black (trade name, MA230; produced by Mitsubishi Chemical Corporation) based on 100.0 parts by mass of polyesterdiol (trade name, Nippollan 4010P; produced by Nippon Polyurethane Industry Co., Ltd.) were stirred and mixed. After that, the same manner as in Example 1 was performed to provide a developing roller of Comparative Example 2.

Comparative Example 3 to 7

A developing roller of each of Comparative Example 3 to Comparative Example 7 was obtained in the same manner as in Example 10 except that the acrylic resin C-2 as the material for the surface layer 4 was changed as shown in Table 5.

TABLE 5

| | Surface layer | | | Carbon | | |
|---|---|---|---|---|---|---|
| | | Isocyanate | | black | Acryl | |
| Comparative Example | Polyol Type | Type | Compounded amount based on 100 g of polyol (g) | Compounded amount based on 100 g of polyol (g) | Type | Compounded amount based on 100 g of polyol (g) |
| 1 | "PTMG3000" | "MR200" | 26.8 | 21.9 | C-2 | 11.0 |
| 2 | "Nippollan 4010P" | | 40.6 | 22.9 | | 11.5 |
| 3 | "P-2010" | 3-2 | 104.8 | 31.5 | C-13 | 15.8 |
| 4 | | | | | C-14 | |
| 5 | | | | | C-15 | |
| 6 | | | | | C-16 | |
| 7 | | | | | C-17 | |

The developing rollers of Examples 1 to 26 and Comparative Examples 1 to 7, obtained as described above, were evaluated for the following items.

[Evaluation of Residual Deformation Amount]

Figure 5:
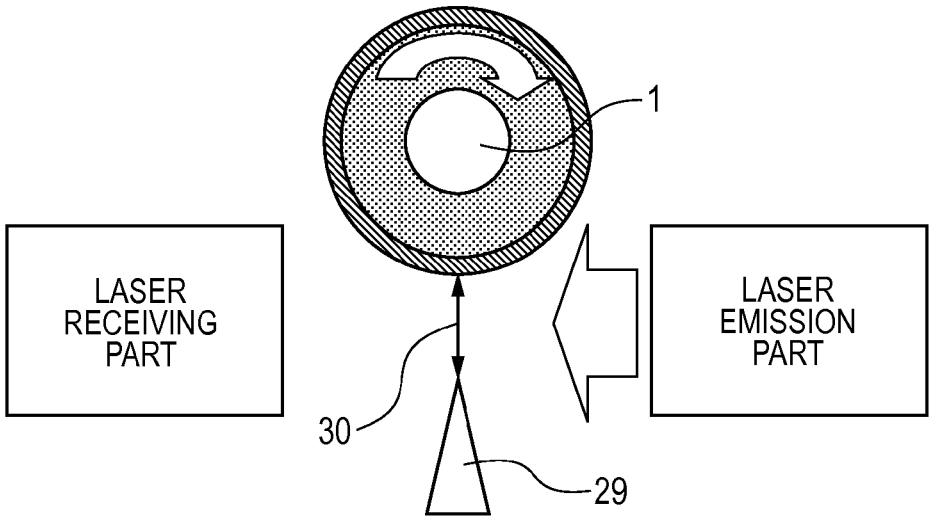
FIG. 5 is a schematic cross-sectional view of a measurement apparatus for measuring the outer diameter dimension of the developing roller of the present invention.

The outer diameter dimension of each of the resultant developing rollers of the present Examples and Comparative Examples was measured using such an apparatus as illustrated in FIG. 5. The present measurement apparatus is provided with a conductive mandrel bearing (not illustrated) that rotates based on a conductive mandrel, an encoder (not illustrated) that detects the rotation of the conductive mandrel, a base plate 29, and a laser dimension measuring instrument (LS-7000 (trade name), manufactured by Keyence Corporation) including a laser emitting part and a laser receiving part. A gap amount 30 between the surface of the developing roller and the base plate was measured to thereby calculate the outer diameter dimension of the developing roller. Herein, the measurement of the gap amount between the surface of the developing roller and the base plate was performed with respect to 3 points in total, including the central portion of the elastic layer in the longitudinal direction, and points of 20 mm each from both end portions of the elastic layer to the central portion in the longitudinal direction, at 360 points at a pitch of 1° with respect to one turn of the developing roller. The measurement was performed in an environment of a temperature of 23° C. and a humidity of 55% RH using a roller left to stand in an environment of a temperature of 23° C. and a humidity of 55% RH for 6 hours or more.

The developing roller whose outer diameter shape had been measured in advance as described above was incorporated in a cyan cartridge for a laser printer (trade name, LBP7700C; manufactured by Canon Inc.). In this regard, the abutting pressure between the developing roller and the developing blade was adjusted to 50 gf/cm, which was stringent for residual deformation. Then, the cartridge was left to stand in an environment of a temperature 40° C. and a humidity of 95% RH for 30 days, thereafter, the developing roller was taken out to an environment of a temperature of 23° C. and a humidity of 55% RH and left to stand in an environment of a temperature of 23° C. and a humidity of 55% RH for 6 hours, and thereafter the outer diameter shape of the developing roller was measured in an environment of a temperature of 23° C. and a humidity of 55% RH. The outer diameter shape was measured with respect to the same position as the position before the cartridge was left to stand in an environment of a temperature of 40° C. and a humidity of 95% RH to determine a change in outer diameter dimension of the developing roller before and after the cartridge was left to stand at the abutting position of the developing blade, and the change was defined as a residual deformation amount.

[Evaluation of Set Image]

The developing roller whose residual deformation amount had been measured was incorporated in a cyan cartridge for a printer LBP7700C manufactured by Canon Inc. to produce a cartridge for an image output test.

The produced cartridge for an image output test was incorporated in a printer LBP7700C manufactured by Canon Inc. and subjected to an image output test. A halftone image was output and ranked as follows. Herein, a period from the measurement of the residual deformation amount to the image output was set to 1 hour.

A: Uniform image was obtained.

B: Density unevenness due to deformation of developing roller is very slightly observed.

C: Density unevenness due to deformation of developing roller is observed on end portion or the whole of image.

[Measurement of Surface Hardness Under Low-Temperature and Low-Humidity]

Each of the resultant developing rollers of the present Examples and Comparative Examples was left to stand in an environment of an air temperature of 15° and a relative humidity of 10% RH (hereinafter, abbreviated as "L/L environment") for 24 hours. Then, the measurement was performed by a micro rubber hardness tester (trade name: MD-1capa, manufactured by Kobunshi Keiki Co., Ltd.) using a probe having a diameter of 0.16 mm with respect to 3 points including the central portion, the upper end portion and the lower end portion of the developing roller, and the average value was defined as the surface hardness under low-temperature and low-humidity.

[Evaluation of Filming Resistance]

Each of the developing rollers of the present Examples and Comparative Examples being loaded on a laser printer (trade name, LBP7700C; manufactured by Canon Inc.) having such a configuration as illustrated in FIG. 3, and the evaluation of filming was performed by the printer. Under an L/L environment, a black toner was used to perform continuous printing at a print percentage of 1%. The image was checked every time when 1000 sheets were printed, and the number of sheets when the difference in density between the printed area and the non-printed area by filming was visually seen was defined as the number of sheets when the filming occurred.

The foregoing results are shown in Table 6 and Table 7.

TABLE 6

| | Urethane | | | Acryl | | | Evaluation result | | | |
|---|---|---|---|---|---|---|---|---|---|---|
| Example | Polyol | Isocyanate group terminal prepolymer | Formula of contained structure | No. | Formula of contained structure | Tg | Residual deformation amount (μm) | Set image | Surface hardness (L/L) | Number of sheets when filming occurred |
| 1 | A-1 | B-1 | (1) (2) (3) | C-1 | (5) | 20 | 2 | A | 35.8 | 19000 |
| 2 | | | | C-2 | | 60 | 2 | A | 35.9 | 19000 |
| 3 | | | | C-3 | | 120 | 2 | A | 36.0 | 19000 |
| 4 | P-2010 | | (1) (2) (3) | C-4 | | 60 | 3 | A | 36.2 | 18000 |
| 5 | | | (4) | C-5 | | 60 | 3 | A | 36.4 | 18000 |
| 6 | | | | C-6 | | 100 | 3 | A | 36.4 | 18000 |
| 7 | A-2 | | (1) (2) (3) | C-1 | | 20 | 2 | A | 34.5 | 20000 |
| 8 | | | | C-2 | | 60 | 2 | A | 34.7 | 20000 |
| 9 | | | | C-3 | | 120 | 2 | A | 34.7 | 20000 |
| 10 | P-2010 | B-2 | (4) | C-2 | | 60 | 3 | A | 36.5 | 17000 |
| 11 | A-3 | | | | | | 3 | A | 35.1 | 18000 |
| 12 | A-2 | B-3 | (1) (2) (3) | | | | 2 | A | 34.8 | 19000 |
| 13 | A-1 | MR200 | (1) (2) (3) | | | | 4 | B | 36.9 | 14000 |
| 14 | A-1 | B-1 | (1) (2) (3) | C-7 | (6) | 50 | 3 | A | 36.1 | 19000 |

TABLE 6-continued

| | Urethane | | | Acryl | | | Evaluation result | | | |
|---|---|---|---|---|---|---|---|---|---|---|
| Example | Polyol | Isocyanate group terminal prepolymer | Formula of contained structure | No. | Formula of contained structure | Tg | Residual deformation amount (μm) | Set image | Surface hardness (L/L) | Number of sheets when filming occurred |
| 15 | | | | C-8 | | 90 | 2 | A | 36.3 | 19000 |
| 16 | | | | C-9 | | 120 | 2 | A | 36.3 | 19000 |
| 17 | P-2010 | | (1) (2) (3) | C-7 | | 50 | 3 | A | 36.2 | 18000 |
| 18 | | | (4) | C-8 | | 90 | 3 | A | 36.4 | 18000 |
| 19 | | | | C-9 | | 120 | 3 | A | 36.6 | 18000 |
| 20 | A-2 | | (1) (2) (3) | C-10 | | 60 | 2 | A | 34.6 | 20000 |
| 21 | | | | C-11 | | 90 | 2 | A | 34.7 | 20000 |
| 22 | | | | C-12 | | 120 | 2 | A | 34.7 | 20000 |
| 23 | P-2010 | B-2 | (4) | C-8 | | 90 | 3 | A | 36.8 | 16000 |
| 24 | A-3 | | | | | | 3 | A | 35.4 | 18000 |
| 25 | A-2 | B-3 | (1) (2) (3) | | | | 3 | A | 35.0 | 18000 |
| 26 | P-2010 | MR200 | (4) | | | | 4 | B | 37.2 | 12000 |

TABLE 7

| | Urethane | | | Acryl | | | Evaluation result | | | |
|---|---|---|---|---|---|---|---|---|---|---|
| Comparative Example | Polyol | Isocyanate group terminal prepolymer | Formula of contained structure | No. | Formula of contained structure | Tg | Residual deformation amount (μm) | Set image | Surface hardness (L/L) | Number of sheets when filming occurred |
| 1 | PTMG3000 | MR200 | (1) | C-2 | (5) | 60 | 8 | C | 39.7 | 7000 |
| 2 | Nippollan 4010P | | — | | | | 8 | C | 40.2 | 6000 |
| 3 | P-2010 | B-2 | (4) | C-13 | — | 60 | 10 | C | 36.5 | 15000 |
| 4 | | | | C-14 | (5) | 5 | 9 | C | 36.5 | 12000 |
| 5 | | | | C-15 | | 150 | 3 | A | 39.5 | 7000 |
| 6 | | | | C-16 | (6) | 40 | 7 | C | 36.7 | 15000 |
| 7 | | | | C-17 | | 150 | 3 | A | 39.4 | 6000 |

Since the developing rollers of Examples 1 to 26 contain the urethane resin and the acrylic resin of the present invention in the surface layer, the developing rollers have a small residual deformation amount and a good set image even after being left to stand under a stringent high-temperature environment for a long period. In addition, the increase in hardness on the surface of the roller under a low temperature is suppressed, and a good filming-resistant performance is exhibited.

In particular, the developing rollers of Examples 1 to 12 and 14 to 25, each obtained by reacting the polyol having the structures of the structural formula (1), and (2) and/or (3), or (4) with an aromatic isocyanate to provide an isocyanate group terminal prepolymer, and then subjecting the prepolymer to a curing reaction, have a very small residual deformation amount. In addition, the increase in surface hardness is also suppressed at a higher level.

On the contrary, the developing rollers of Comparative Examples 1 and 2, not containing the structure of the present invention in the urethane resin in the surface layer, and also the developing roller of Comparative Example 3, not containing the structure of the structural formula (5) or (6) of the present invention in the acrylic resin, have a large residual deformation amount and cause an image defect. Much the same is true on the developing rollers of Comparative Examples 4 and 6 in which the acrylic resin has a low Tg. On the contrary, with respect to the developing rollers of Comparative Examples 5 and 7 in which the acrylic resin has a Tg of 120° C. or higher, it is observed that the increase in surface hardness results in the deterioration in filming resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-144331, filed on Oct. 27, 2012, and No. 2013-128802, filed on Jun. 19, 2013 which are hereby incorporated by reference herein in their entirety.

What is claimed is:

1. A developing member comprising a mandrel, an elastic layer formed on an outer periphery surface of the mandrel, and a surface layer covering the outer periphery surface of the elastic layer, wherein the surface layer contains a first resin and a second resin, the first resin has at least one structure selected from the group consisting of the following (A) and (B) between adjacent two urethane linkages, (A) a structure represented by the following structural formula (1), and one or both structures selected from the group consisting of a structure represented by the following structural formula (2) and a structure represented by the following structural formula (3);

(B) a structure represented by the following structural formula (4); and the second resin is a resin having a structure of the following structural formula (5), and having a glass transition point Tg of 20° C. or higher and 120° C. or lower:

structural formula (1)

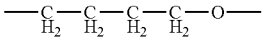

structural formula (2)

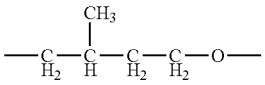

structural formula (3)

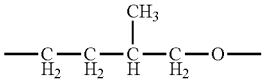

structural formula (4)

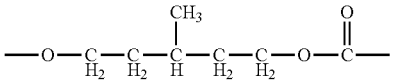

structural formula (5)

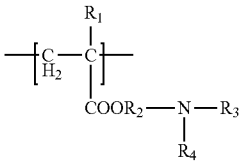

in the structural formula (5), $R_1$ represents a hydrogen atom or a methyl group, $R_2$ represents an alkylene group having 1 to 4 carbon atoms, and $R_3$ and $R_4$ each independently represent an alkyl group having 1 or 2 carbon atoms.

2. The developing member according to claim 1, wherein in the (A), "the molar number of the structure represented by the structural formula (1)":"the sum of the molar number of the structure represented by the structural formula (2) and the molar number of the structure represented by the structural formula (3)" is 80:20 to 50:50.

3. The developing member according to claim 1, wherein the elastic layer comprises a silicone rubber.

4. The developing member according to claim 3, wherein the silicone rubber is a cured product of an addition-curable silicone rubber.

5. An electrophotographic apparatus provided with a developing member according to claim 1, and an electrophotographic photosensitive member arranged abutting the developing member.

6. A process cartridge provided with a developing member according to claim 1, and an electrophotographic photosensitive member arranged abutting the developing member, wherein the process cartridge is configured to be detachable to a main body of an electrophotographic apparatus.

7. A developing member comprising a mandrel, an elastic layer formed on an outer periphery surface of the mandrel, and a surface layer covering the outer periphery surface of the elastic layer, wherein the surface layer is made of a reaction product of a polyol having at least one structure selected from the group consisting of the following (A) and (B), an acrylic resin having a structure represented by the following structural formula (6), and having a glass transition point Tg of 50° C. or higher and 120° C. or lower, and an isocyanate compound:

(A) a structure represented by the following structural formula (1), and one or both structures selected from the group consisting of a structure represented by the following structural formula (2) and a structure represented by the following structural formula (3);

(B) a structure represented by the following structural formula (4):

structural formula (1)

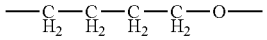

structural formula (2)

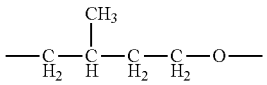

structural formula (3)

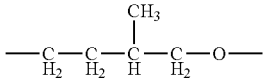

structural formula (4)

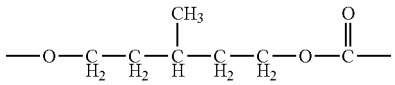

structural formula (6)

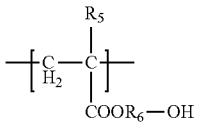

wherein, $R_5$ represents a hydrogen atom or a methyl group, and $R_6$ represents an alkylene group having 1 to 4 carbon atoms.

8. The developing member according to claim 7, wherein the isocyanate compound is an aromatic isocyanate.

9. A developing member comprising a mandrel, an elastic layer formed on an outer periphery surface of the mandrel, and a surface layer covering the outer periphery surface of the elastic layer, wherein the surface layer contains a urethane resin, the urethane resin has a partial structure having at least one structure selected from the group consisting of the following (A) and (B) between two urethane linkages, and, the urethane resin has a partial structure having a structure of the following (C), and not having the structures of the following (A) and (B) between adjacent two urethane linkages:

(A) a structure represented by the following structural formula (1), and one or both structures selected from the group consisting of a structure represented by the following structural formula (2) and a structure represented by the following structural formula (3);

structural formula (1)

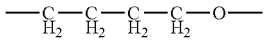

structural formula (2)

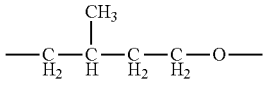

structural formula (3)

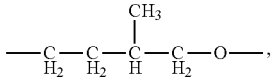

(B) a structure represented by the following structural formula (4):

structural formula (4)

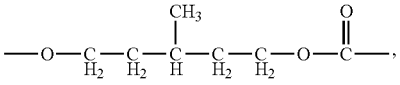

(C) a structure represented by the following structural formula (7), and one or both structures selected from the group consisting of a structure represented by the following structural formula (8) and a structure represented by the following structural formula (9);

structural formula (7)

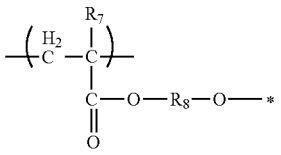

wherein, $R_7$ represents a hydrogen atom or an alkyl group having 1 to 3 carbon atoms, $R_8$ represents an alkylene group having 1 to 4 carbon atoms, and symbol "*" represents a linking position to a carbon atom constituting a urethane linkage;

structural formula (8)

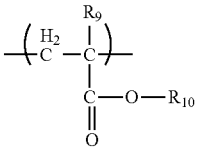

wherein, $R_9$ represents a hydrogen atom or a methyl group, and $R_{10}$ represents an alkyl group having 1 or 2 carbon atoms; and structural formula (9)

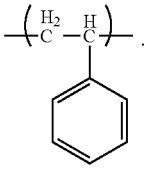

10. The developing member according to claim 9, wherein in the (A), the molar number of the structure represented by the structural formula (1):the sum of the molar number of the structure represented by the structural formula (2) and the molar number of the structure represented by the structural formula (3) is 80:20 to 50:50.

11. The developing member according to claim 9, wherein in the (C), the ratio of the total of the molar numbers of the structure represented by the structural formula (8) and the structure represented by the structural formula (9) to the sum of the molar numbers of the structure represented by the structural formula (7), the structure represented by the structural formula (8), and the structure represented by the structural formula (9) is 50% or more.

* * * * *